United States Patent [19]

Stocking et al.

[11] 4,375,752

[45] Mar. 8, 1983

[54] AIR CONDITIONING APPARATUS

[75] Inventors: George E. Stocking, Louisville; Joseph R. Noland, Crestwood; Donald L. Sidebottom, Louisville, all of Ky.

[73] Assignee: General Electric Company, Louisville, Ky.

[21] Appl. No.: 300,081

[22] Filed: Sep. 8, 1981

[51] Int. Cl.[3] ..... F25D 21/00

[52] U.S. Cl. ..... 62/150; 62/160; 62/280; 62/305; 62/324.1

[58] Field of Search ..... 62/279, 280, 305, 324.1, 62/91, 150, 760

[56] References Cited

U.S. PATENT DOCUMENTS

| | | | |
|---|---|---|---|
| 2,777,303 | 1/1957 | Slattery | 62/140 |
| 2,797,560 | 7/1957 | Kooiker et al. | 62/140 |
| 2,911,797 | 11/1959 | Stocking | 62/176 |
| 2,982,110 | 5/1961 | Kramer | 62/91 |
| 3,152,454 | 10/1964 | Eberhart | 62/150 |
| 4,136,529 | 1/1979 | McCarty | 62/280 |

*Primary Examiner*—Lloyd L. King

*Attorney, Agent, or Firm*—F. P. Giacalone; R. M. Reams

[57] ABSTRACT

In a self-contained air conditioner unit of the reversible refrigeration system type having cooling and heating cycles, a no-drain heat pump is provided wherein in the heating cycle, water collected on the outdoor heat exchanger operating as the system evaporator is transferred by a condensate disposal system to the indoor section. The condensate is atomized and directed into the indoor air flow and against the relatively warm indoor heat exchanger operating as the condenser to humidify the air. Control means are provided that prevent the condensate disposal system from directing condensate into the indoor air flow during the cooling cycle.

4 Claims, 8 Drawing Figures

AIR CONDITIONING APPARATUS

CROSS REFERENCE TO RELATED APPLICATIONS

This application is related to concurrently filed applications Ser. Nos. 299,913 filed Sept. 8, 1981 in the name of George E. Stocking, and 300,351, filed Sept. 8, 1981 jointly in the names of George E. Stocking and Bruce L. Ruark, each assigned to the General Electric Company, the assignee of the present invention.

BACKGROUND OF THE INVENTION

Conditioning the air within an enclosure has been accomplished by self-contained unit employing a refrigeration heat pump with the unit generally located within an opening in the enclosure. In order to both heat and cool the air within the enclosure, the reversible type refrigeration apparatus has been used including two heat exchangers, one located so as to allow recirculation of the enclosure air therethrough and the other located so as to allow the recirculation of outdoor air therethrough. The heat exchangers operate interchangeably as condensers and evaporators to both heat and cool the enclosure. Control means are provided by which reversal of the refrigeration cycle can be obtained.

The units are usually provided with sump areas located in the outdoor section of the unit at a level below the heat exchangers. Conduit means are provided for directing condensate collected by the indoor heat exchanger when it functions as an evaporator to the sump area, while condensate collected from the outdoor coil when it functions as the evaporator is also directed into the sump area. Condensate removal means operable in the cooling cycle directs the condensate from the sump into the outdoor coil functioning as the condenser to cool it and dispose of the condensate by evaporation. The condensate collected in the sump during the heating cycle when the outdoor heat exchanger functions as the evaporator cannot be disposed of in this manner and may, in fact, freeze since the unit may at times operate at below freezing temperatures. Water frozen in the sump area may in some instances result in locked fans which can result in blown fuses, burned out motor and other damages.

Some prior art attempts have provided drains in the sump area, such as disclosed in U.S. Pat. No. 2,777,303-Slattery, assigned to the General Electric Company, the assignee of the present invention. The patent teaches the use of a thermally responsive element that cooperatively opens the drain when the outside temperature falls below a predetermined temperature to drain the sum of any condensate that may have collected.

U.S. Pat. No. 2,982,110-Kramer appears to disclose an apparatus that selectively conducts condensate formed at the outdoor heat exchanger to the vicinity of the indoor heat exchanger during the heating cycle in accordance with predetermined humidity conditions in the vicinity of the latter heat exchanger, and treats the circulating air being heated by entraining the condensate therein.

U.S. Pat. No. 4,136,529-McCarty, assigned to the General Electric Company, the assignee of the present invention, discloses an apparatus wherein the condensate collected in the outdoor sump in the heating cycle is disposed of by directing it to the indoor section where it is entrapped in the recirculating enclosure air and passed through the relatively warm indoor heat exchanger to humidify the air.

SUMMARY OF THE INVENTION

The present invention relates to a condensate disposal control system for a self-contained air conditioning unit for heating and cooling and includes a casing mounted in an aperture in the wall of an enclosure to be conditioned. Arranged in the casing is a chasis including a base portion and a barrier dividing the chassis into an indoor and an outdoor compartment. Mounted in the inner compartment is an indoor heat exchanger and a fan for recirculating enclosure air through the indoor compartment. Mounted in the outdoor compartment is an outdoor heat exchanger, a fan for circulating air through the outer compartment, the system compressor, and a reversing valve for selectively connecting the compressor to the heat exchangers whereby the outdoor heat exchanger functions as an evaporator during the heating cycle and the indoor heat exchanger functions as the evaporator during the cooling cycle.

In the heating cycle, water condensed on the outdoor heat exchanger functioning as an evaporator during heating collects in a sump in the outdoor compartment. The water is lifted out of the sump and directed into the air flow circulating through the indoor section where it atomizes and passed through the relatively warm indoor heat exchanger functioning as a condenser to humidify the air.

A motor driven disc is employed to lift the condensate from the sump area and for directing it into the indoor air stream. The control system includes circuit means arranging the condensate motor in parallel circuit with the outdoor fan so that the condensate motor is de-energized together with the outdoor fan. The control system further includes a thermostat for de-energizing the condensate disposal means when the unit is in the cooling cycle to insure operation of the condensate disposal means only when the unit is in the heating cycle and prevented from operating when the unit is in the cooling cycle.

DESCRIPTION OF THE PREFERRED EMBODIMENT

Figure 1:
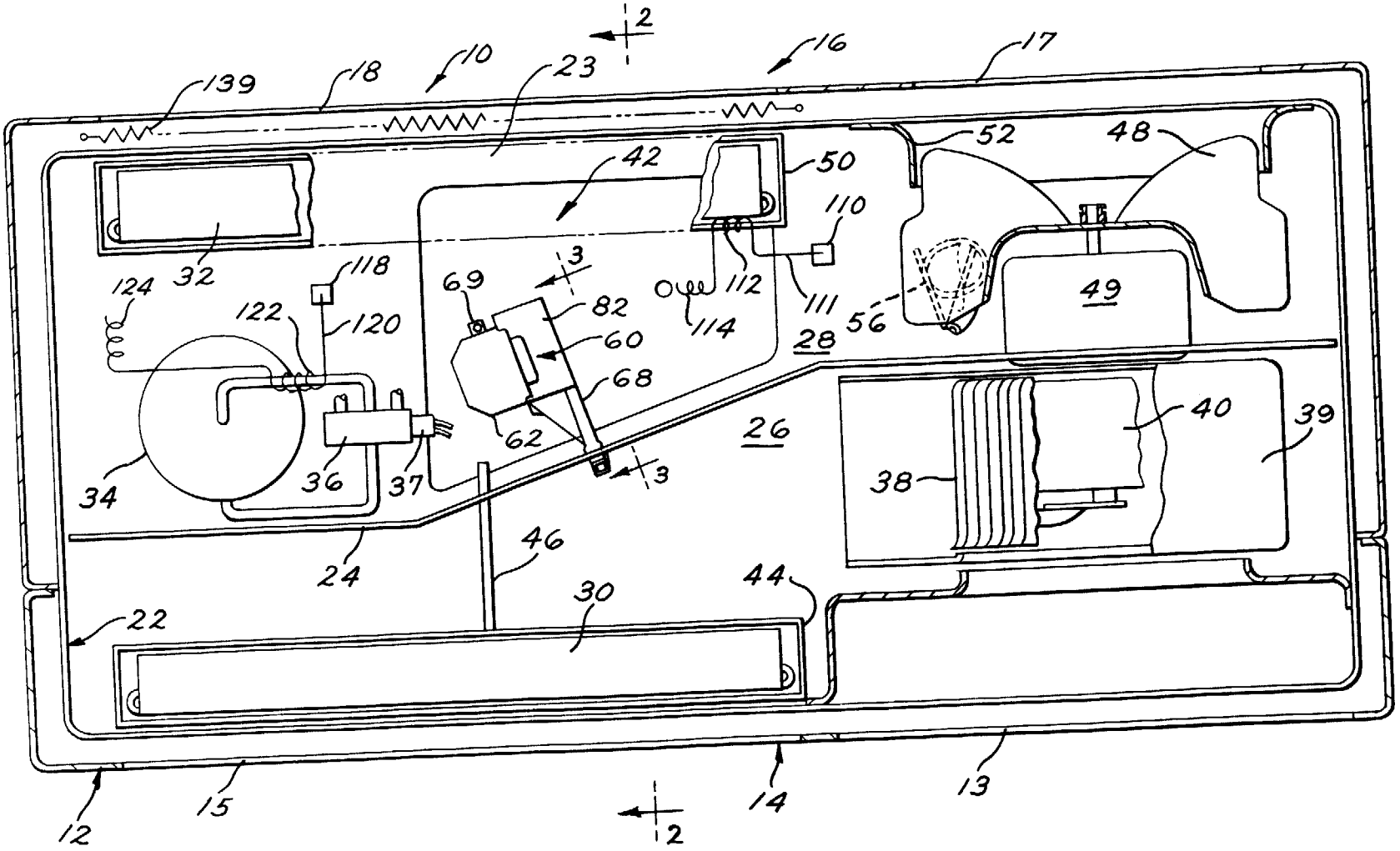
FIG. 1 is a plan view partially in section of an air conditioning unit incorporating the condensate disposal system of the present invention.

Referring now to the drawings and initially to FIG. 1 thereof, there is illustrated an air conditioner unit 10 which is arranged to be positioned within an opening of an enclosure. The unit includes a casing or outer sleeve 12 having a front opening 14 including an inlet 13 and an outlet 15 disposed in the enclosure to be conditioned, and a rear opening 16 including an inlet 17 and an outlet 18 exposed to the outdoor ambient. A chassis unit 22 including the refrigeration system and components of the unit is arranged in the sleeve 12. The chassis 22 includes a base 23 that is divided by a partition or barrier 24 into an indoor compartment 26 and an outdoor compartment 28 in which are mounted respectively an indoor heat exchanger 30 and an outdoor heat exchanger 32. The heat exchangers 30 and 32 are connected in refrigerant flow relationship with a compressor 34 also positioned in the outer compartment 28.

In the illustrated embodiment of the invention, the refrigeration system is a heat pump of the reversible refrigerant flow type, and is provided with a reversing valve 36. The valve 36 may be selectively operated by a solenoid 37 to reverse the flow of refrigerant to the heat exchanger units 30 and 32 so that they function interchangeably as the evaporator or condenser to heat or cool the respective air streams circulated over the heat exchangers.

Figure 2:
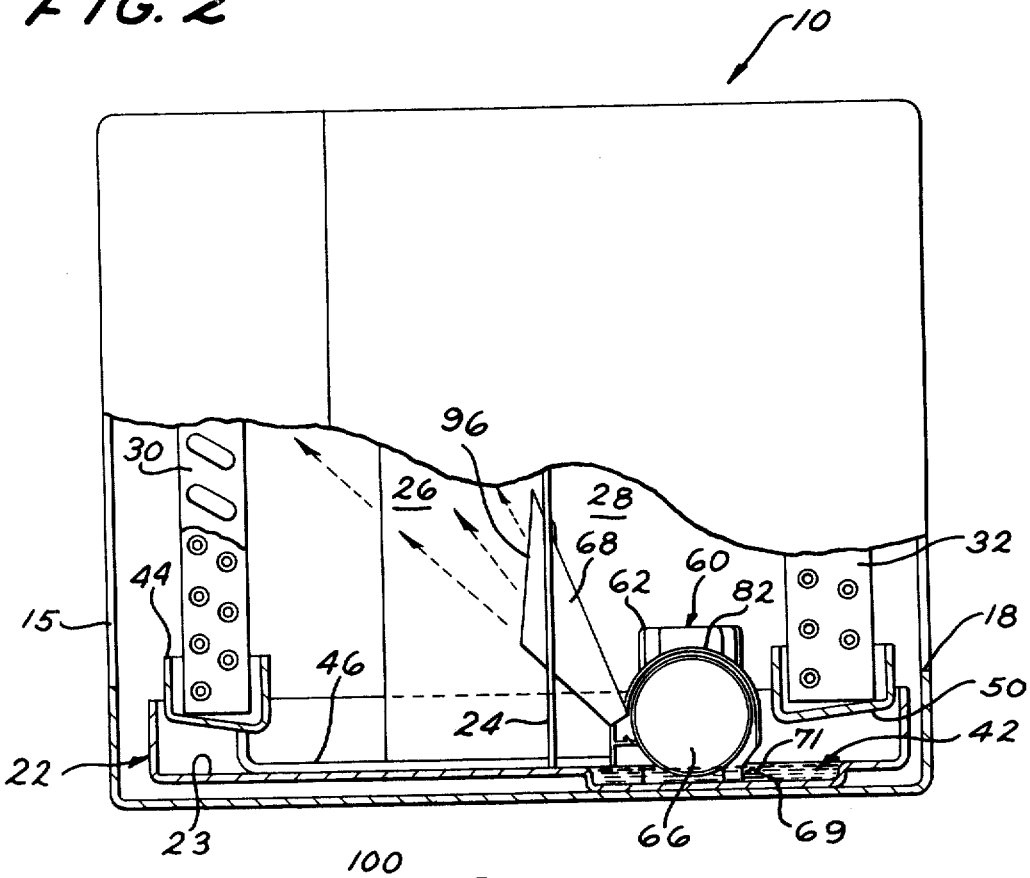
FIG. 2 is a partial side elevational view taken along line 2—2 of FIG. 1.

When the conditioner is in operation, air is drawn from within the enclosure through inlet 13 and recirculated by an air moving means or blower wheel 38 arranged in a scroll 39. The room air is directed through the indoor compartment 26, passed through the heat exchanger 30 the through outlet 15. The blower 38 is driven by a motor 40 mounted on the inside wall of the barrier 24. During operation of the unit in the cooling cycle, the heat exchanger 30 is functioning as the system evaporator and moisture from the air stream being circulated over the heat exchanger 30 is condensed onto its coil surfaces. Means are provided for collecting this condensate water and delivering it to a water receptacle or sump area 42 formed in the base 23 of chassis 22 in the outer compartment area 28. More specifically, these means include a suitable drip tray 44 as seen in FIGS. 1 and 2. Water collected in the tray 44 is delivered to the sump area 42 through a conduit 46 extending from the tray 44 to an open end communicating with the sump area 42 in the outdoor compartment. With the air conditioning unit operating in the cooling cycle, the outdoor heat exchanger 32 functions as the system condenser and is cooled by the outdoor air being circulated thereover by a fan 48 driven by the motor 49 mounted on the outside wall of the barrier 24.

When the unit is operating on the heating cycle, the reversing valve 36 is positioned to reverse the flow of refrigerant to the heat exchangers 30 and 32, thereupon utilizing the indoor heat exchanger 30 as the system condenser. The outdoor heat exchanger 32, now functioning as the system evaporator, condenses moisture out of the outside air. Condensate water from heat exchanger 32 accumulates in a drip tray 50 and is thereby delivered to the condensate collection sump 42. As will be explained in detail hereinafter, it is this water collected in the sump area 42 from the outdoor heat exchanger that is transferred to the indoor compartment when the unit is operating in the heating cycle and therein added to the recirculating indoor air.

It is to be noted that sump area 42 may take on any desirable form and is, of course, not limited to the arrangement wherein the water collecting area forms the entire or substantially the entire bottom wall of base 23 in the outdoor side 28 of chassis 22. In the cooling cycle, water collected in the sump 42 from the indoor heat exchanger 30 is disposed in the following manner. Air moving means 48 for circulating air through the outdoor compartment 28 is disposed so that it circulates at least a portion of the air stream in a direction substantially parallel with and over the surface of the water in the sump 42. More specifically, the air that fan 48 draws inwardly through the inlet opening 17 and the orifice opening 52 impinges on the barrier 24 and is diverted radially by the fan 48 and barrier 24 into the remaining portions of the outdoor compartment 28.

In the embodiment shown, the fan 48 is a mixed-flow fan in which the air is propelled rearwardly by the forward portions of the fan blades and turned within the fan to be propelled in a direction normal to the axis of the fan. The mixed-flow fan 48 circulates a stream of air along the surface of the water in the sump 42 and this air stream, as will hereinafter be described, aids in the entrainment of water droplets from the sump 42 into the air stream flowing through the outdoor compartment. The air stream flows through the remaining portions of the outdoor compartment 28, over the heat exchanger 32, and then discharged to the outdoors through an outlet opening 18. It should be noted that while a mixed-flow fan creates a great deal of radial air flow, this is also true of the normal axial flow fan and such a fan could be used as long as a portion of the air stream discharging therefrom passes over the surface of the water in the sump 42.

In order to aid in disposing of condensate water collected in the sump 42, an air vortex generator 56 of the type fully explained in U.S. Pat. No. 3,079,767, assigned to the General Electric Company, the assignee of the present invention, may be used. The vortex generator 56 is designed to receive or trap a portion of the air stream circulating through the outer compartment and to impart a swirling motion, as well as a thrust, to this swirling air mass in an angular direction with respect to the original direction of air flow, thereby creating a relatively stable air vortex discharging from the generator.

Means operable in the heating cycle are provided for transferring the condensate water collected in the sump 42 during the heating cycle to the indoor compartment where the moisture may be added to the indoor air being recirculated by the blower 38.

In carrying out the disposal of condensate generated when the unit is operating in the heating cycle while at the same time humidifying the indoor air, means are provided for transferring the condensate collected in the outdoor compartment sump area 42 into the air stream being recirculated by blower 38 through the enclosure. The means for transferring the condensate into the indoor air stream includes a slinger mechanism 60 arranged in the outdoor chamber 28. The slinger mechanism is positioned in the sump area 42 generally between the partition 24 and the heat exchanger 32, and in alignment with the indoor heat exchanger 30. As shown in FIG. 2, the slinger mechanism 60 includes a housing 62, a motor driven slinger disc 66 and a condensate passageway 68 through which the condensate is transferred to the indoor compartment 26. The slinger mechanism 60 may be secured to the unit chassis 22 in any suitable manner such as by a bracket 69 and fastening means 71.

Figure 5:
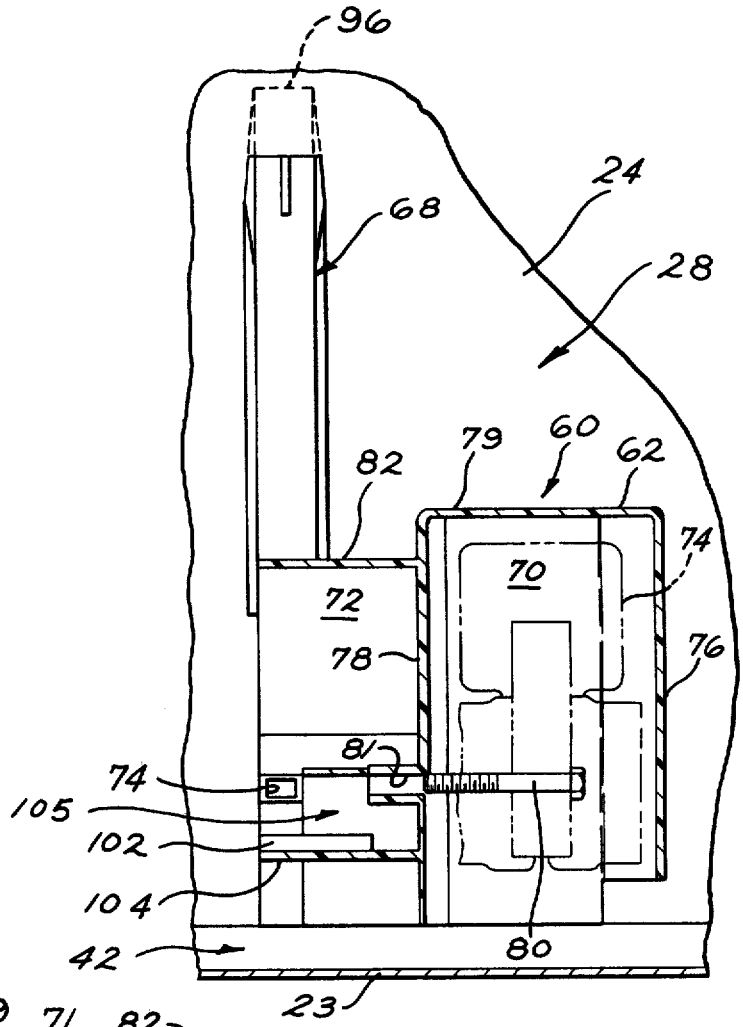
FIG. 5 is a side elevational view in section taken along line 5—5 of FIG. 3.
Figure 6:
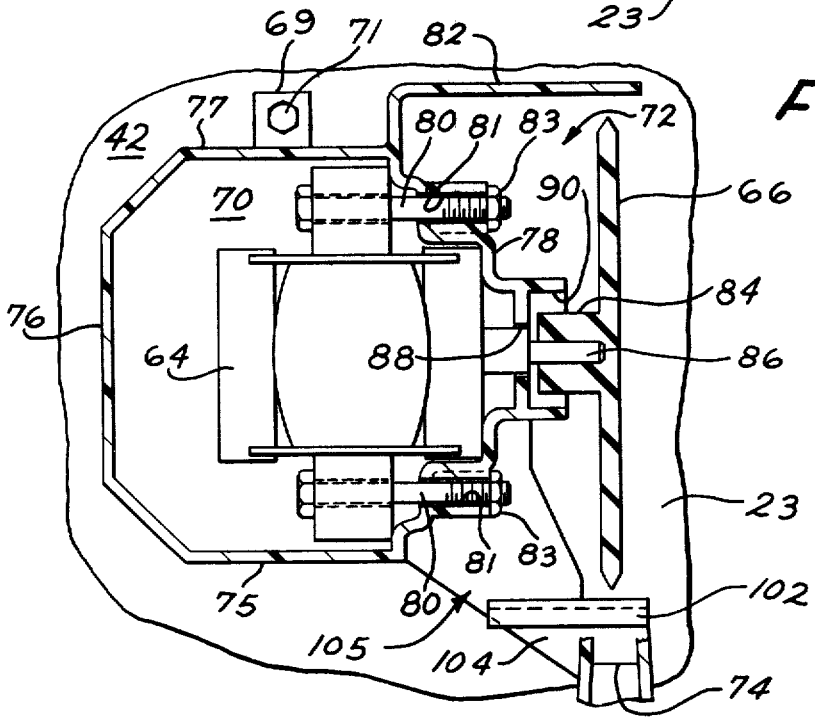
FIG. 6 is a plan view in section taken along line 6—6 of FIG. 3.

Referring now to FIGS. 5–6, the housing 62 is formed to provide an interior motor compartment portion 70 and a lifting area 72 in which the slinger disc 66 is arranged. The inlet 74 (FIGS. 3 and 7) of condensate transfer passageway 68 through which condensate is directed to the indoor compartment 26 communicates with the lifting area 72. The compartment 70 has a generally square cross section as seen in FIG. 6 and includes side walls 75, 76, 77, 78 and a top wall 79 leaving an open bottom through which the motor 64 is mounted. The lower-most portions of the housing 62 side walls are dimensioned to be arranged in the sump 42.

The motor 64 is mounted in the compartment 70 of the housing and secured to the wall 78 by suitable screws or bolts 80 that extend from the motor. The compartment 70 is dimensioned so that the motor 64 and its extending bolts 80 can be inserted into the compartment through the open bottom. With the motor so positioned in compartment 70, the bolts 80 are then aligned with and inserted into appropriately dimensioned opening 82 in wall 78 and secured thereto by nuts 83. The positioning of the motor 64 within the substantially enclosed compartment 70 provides adequate protection for the motor from the condensate and moisture in the surrounding atmosphere to the extent that a standard open type motor may be employed rather than a more expensive enclosed water resistant type. The motor 64 includes a substantially horizontally disposed drive shaft 86 that extends through an aperture 88 in the wall 78 of housing 62 so as to be positioned in the area 72. The area 72 is generally defined by the wall 78 of housing 62, and an arcuate cover or hood portion 82 that extends from housing 62. The area 72 and hood 82 serve to prevent water spinning off disc 66 that does not enter inlet 74 from spraying the outdoor compartment, and more particularly the outdoor heat exchanger, with condensate during the heating cycle which under some ambient conditions may freeze. The aperture 88 in the wall 78 is centered with respect to a horizontally projecting collar 90. The disc 66 includes a hub 84 that is positioned within the collar 90 when the disc is as shown in FIG. 6 rotatably mounted on the drive shaft 86. This arrangement provides a labyrinth that effectively prevents water from reaching the area of the aperture 88 and possibly invading the compartment 70 and contacting the motor 64.

Figure 7:
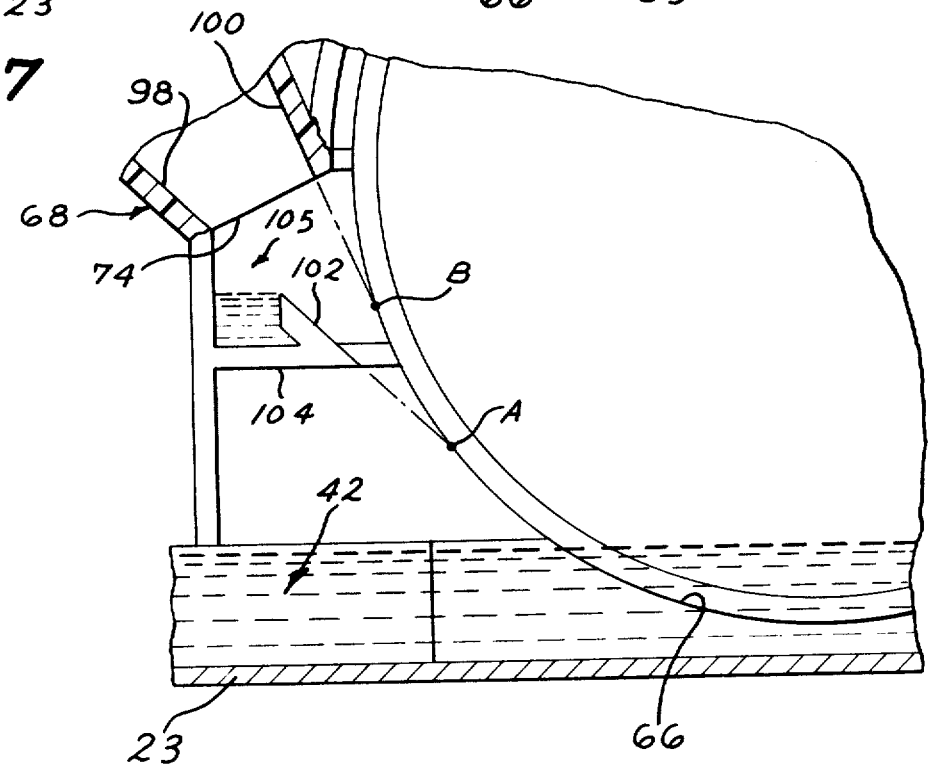
FIG. 7 is an enlarged fragmented elevational view showing details of the mechanism.
Figure 3:
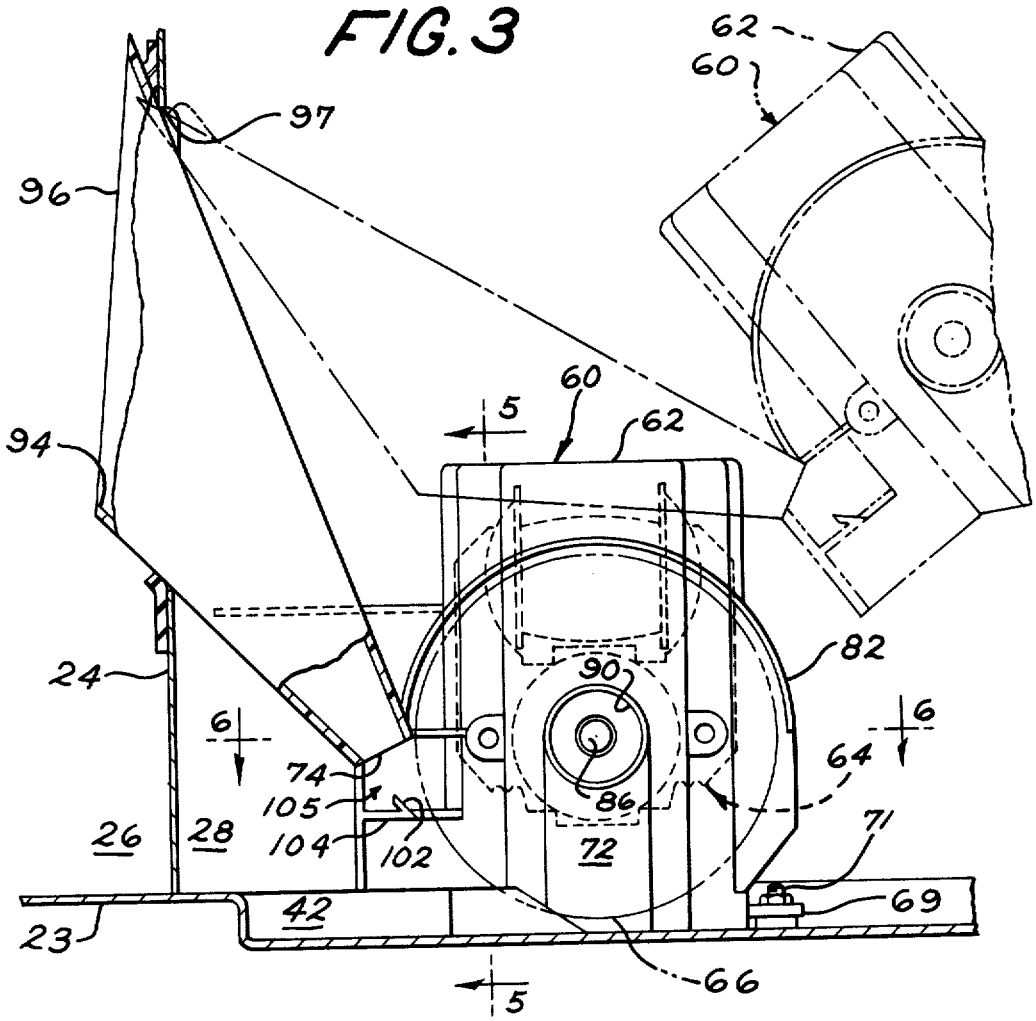
FIG. 3 is a side elevational view of the condensate slinger mechanism taken along line 3—3 of FIG. 1.
Figure 4:
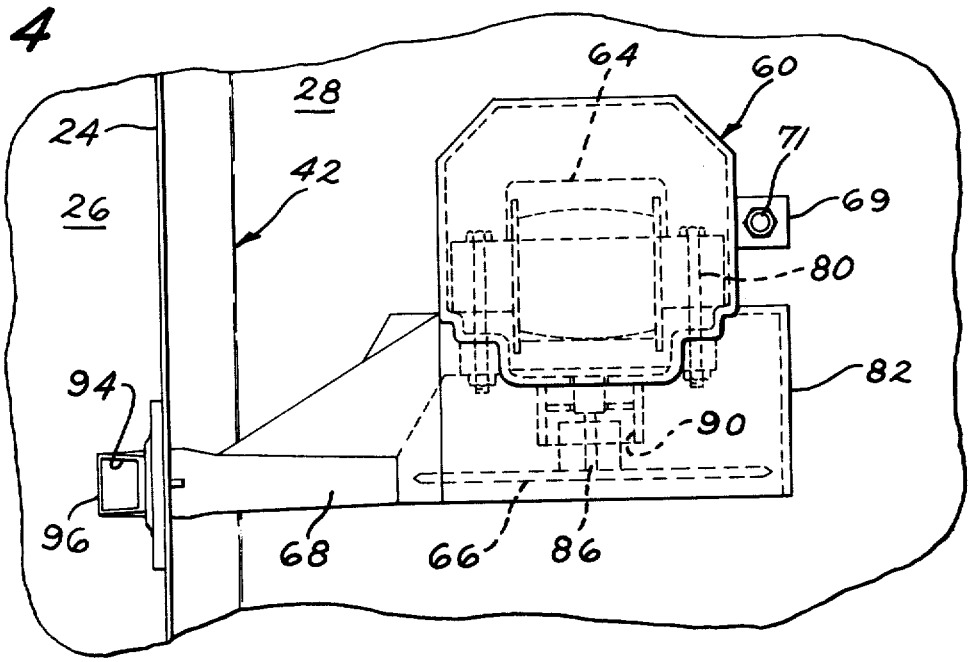
FIG. 4 is a plan view of the mechanism shown in FIG. 3.

As shown in FIGS. 2, 3 and 7, the lower portion of disc 66 is positioned in the sump area 42 and will be submerged in condensate when it is present in the sump. The passageway 68 in the present embodiment is formed as an integral part of slinger mechanism 60 and extends from area 72. The passageway 68 includes the inlet 74 communicating with area 72 and an outlet 94 at its other end 96. The end 96 of passageway 68 is arranged in an opening 97 in the barrier 24 so that the outlet 94 is in fact positioned in the indoor compartment 26. Referring to FIGS. 3 and 7, it will be seen that the bottom wall 98 of passageway 68 is in a plane that generates generally radially from a point A tangent with the circumferential edge of the disc 66. The top or upper wall 100 of passageway 68 is in a plane that generates radially from a second point B tangent with the circumferential edge of the disc 66. In effect, the passageway 68 fans out from the relatively small inlet 74 to the substantially larger outlet 94. This fanning out of passageway 68 insures that the condensate entering the relatively small inlet 74 will exit the outlet 94 substantially unobstructed. In operation, during the heating cycle, the slinger disc 66 driven by motor 64 picks up the condensate water from the sump 42 and spins out or throws a relatively thin wall of fine mist upwardly through the inlet 74 in a pattern extending substantially between the lower and upper walls 98 and 100 respectively and into the indoor compartment 26. To insure that a fine or thin wall of water is thrown out by the disc 66, the circumferentially disposed edge thereof is tapered as shown in FIG. 6. A portion of this thin wall of mist emerging from outlet 94 is drawn into the air stream circulating through the indoor compartment 26 with the remaining portion of condensate being thrown directly into the surface area of the indoor heat exchanger 30. By positioning the walls 98 and 100 so that they are each in a plane generally tangent with a point on the outer peripheral edge of the disc 66, water spinning off the disc will not impinge on the surface of walls 98 and 100. This arrangement is critical since any water impinging on the walls and particularly the lower wall 98 will tend to accumulate and run down the wall. This accumulation of water running down the wall 98 will be met at the inlet 74 with water spinning off disc 66. This interference between water coming off the disc and that accumulating on wall 98 will cause a restriction to the passage of condensate or, in the extreme situation, a blockage at the relatively small inlet that would prevent transfer of condensate through passageway 68.

Means are provided to prevent blockage of the inlet 74 by water accumulating on the surface wall 98. To this end, a short wall 102, as shown in FIGS. 3, 5 and 7, is provided downstream of inlet 74 to function in the following manner. The surface of wall 102 is in substantially the same plane as wall 98 and is arranged on a shelf 104 extending from the inlet 74. The wall 102 is spaced from inlet 74 to provide a gap or space 105 between wall 102 on the lowermost edge of wall 98 at the inlet 70. The arrangement of the wall 102 relative to wall 98 providing the gap 105 causes water that may accumulate on wall 98 to run out of inlet 74 and into the gap 105 therebetween when it will land on shelf 104 and run off back into sump area 42. Water that impinges on the short wall 102 will either by driven into the gap 105 and run off the shelf 104 or will run back down the wall 102 to drip off the lowermost edge of wall 102 and into the sump area. The length of wall 98 and its angle is selected so that any portion of water lifted by disc 66 from sump 42 that does not have sufficient velocity to reach the surface of heat exchanger 30 is returned to the sump 42.

In operation of the condensate disposal system, the heat of the indoor heat exchanger 30 functioning as the system condenser is effective in evaporating the moisture as it contacts and passes through the heat exchanger whereupon the vapor and any remaining moisture flows with the recirculating air into the enclosure being conditioned to provide humidification of the enclosure air. This entrainment of moisture continues so long as the level of condensate water in sump 42 is at or above the lower peripheral edge of disc 66.

With the condensate collecting sump arranged outdoors, it is subjected to the outdoor ambient which may be below freezing during certain operating times when the unit is in the heating cycle. Accordingly, means are provided by the present invention to prevent the operation of the motor 64 in the event that condensate, when present in the sump, freezes around the disc 66 that may cause damage to the slinger mechanism and to save energy. Further control means are provided to prevent operation of the slinger mechanism when the unit is in the cooling cycle so that condensate will not be directed at the indoor heat exchanger when it is functioning as the system evaporator.

Figure 8:
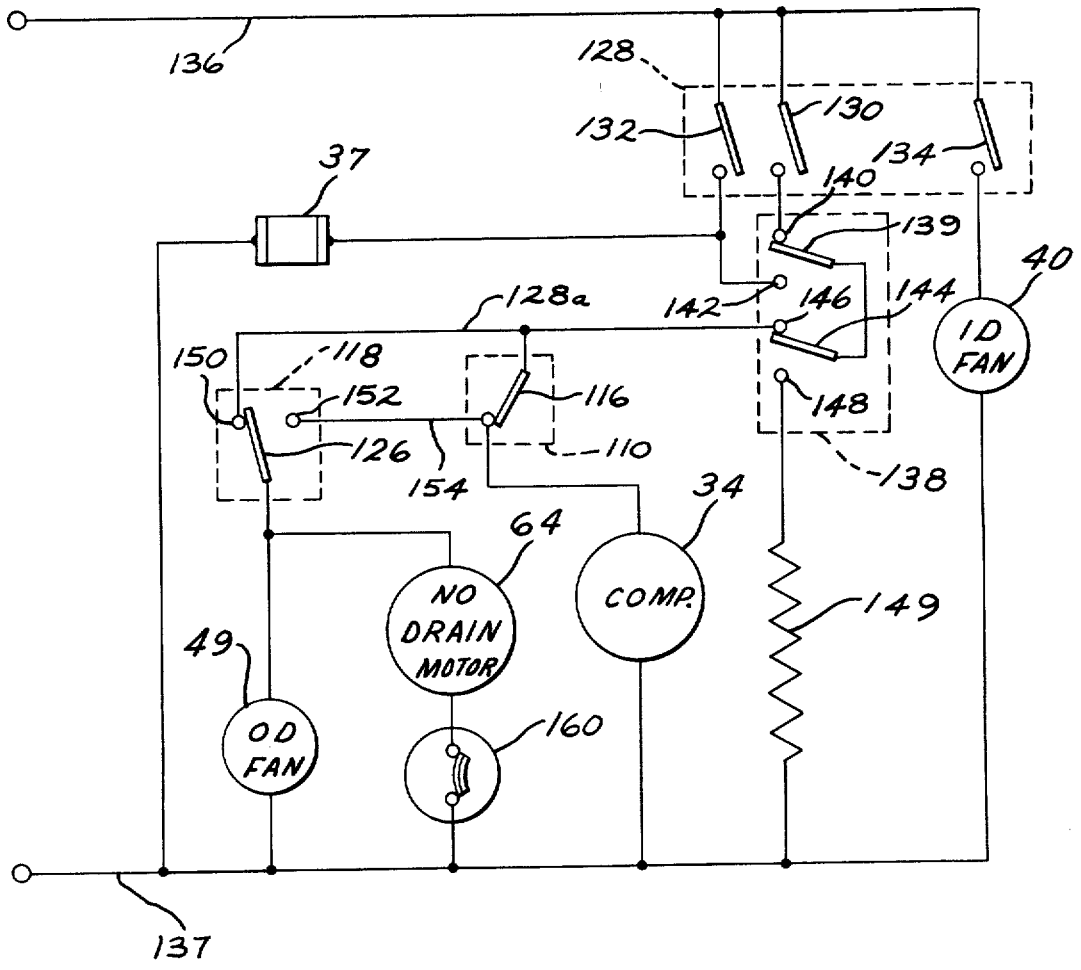
FIG. 8 is a wiring schematic showing a control system for the air conditioning unit.

To this end, means are incorporated to the control system as shown in FIG. 8. The control system employed in carrying out the present invention is similar to that fully disclosed in U.S. Pat. No. 4,102,391-Noland assigned to the General Electric Company, the assignee of the present invention.

For a more complete understanding of the control circuitry, reference is made to the wiring diagram shown in FIG. 8 of the drawing. A selector switch 128 allows energization of the air conditioning unit, and selects the operation thereof on either the heating or cooling cycle. Switch 128 includes a cooling switching means 130 and a heating switching means 132 by which the operation of the unit on either the cooling cycle or the heating cycle can be selected. Switch 128 also provides a circuit through a switch 134 to selectively operate the indoor fan motor 40 on high or low fan speed.

In operation with the selector switch 128 in the heat position, a circuit is completed from supply line 136, solenoid 37 to line 137 to activate the reversing valve 36 thereby placing the refrigeration system in the heat pump mode. The enclosure temperature control thermostat 138 supplies power to the remaining control circuit through a first stage switch 139 operable between a contact 140 in the cooling mode and contact 142 in the heating mode. Thermostat 138 is also provided with second stage switching means 144 movable between a contact 146 which controls operation of the compressor 34 and outdoor fan motor 49 and a contact 148 which controls operation of an auxiliary heater 149. The auxiliary heat is accordingly energized only when the temperature of the enclosure drops to a second lower preselected temperature. Power to the compressor 34 and outdoor fan 49 is through a frost control thermostat 110 while power to the outdoor fan 49 is through a frost control thermostat 118 and/or control 110.

Power from supply line 136 passes through contact 146 to the switching means 116 of the frost control 110. The switching means 116 is arranged to be closed above a preselected temperature (35° F.) and open below a preselected temperature (10° F.). It should be noted that the indoor fan motor 40 will run continuously at its preselected speed during operation of the unit on either the heating or the cooling cycle. The switching means 126 of frost control 118 which controls the operation of the outdoor fan motor 49 is arranged to move between an upper temperature (35° F.) contact 150 and a lower temperature (30° F.) contact 152. Accordingly, power is supplied to contact 150 from contact 146 through line 128*a* while contact 152 receives power from switch 116 through line 154.

In operation, when the temperature sensed by control 110 is above a preselected upper or frost accumulation temperature, a circuit is completed through control 110, compressor 34, to line 137 to energize the refrigeration system in the heat pump mode. In the event that the temperature sensed by control 118 is above a preselected upper or frost producing temperature, a circuit is completed through contact 150 of switch means 126 to energize the outdoor fan motor 49.

In the event control 110 senses a predetermined frost accumulation temperature in the heating mode, the switching means 116 will open. The circuit to the compressor 34 in this instance will be broken, thereby deenergizing the refrigeration system to prevent additional frost from forming on heat exchanger 32. If, during the time the control 110 is positioned by a frosting temperature to deenergize the compressor 34 and the control 118 senses a low frost producing temperature, the switching means 126 will move from contact 150 to contact 152 so that the outdoor fan will be deenergized.

Up to this point, the description of the control system employed in controlling operation of the air conditioning unit has been similar to that disclosed in the above-mentioned U.S. Pat. No. 4,102,391.

In the present embodiment shown of the invention, operation of the slinger mechanism motor 64 is in parallel with the outdoor fan 49 and in series with the thermostat switch 126. Accordingly, motor 64 is energized only when fan 49 is allowed to operate through switch 126. Since thermostat switch 126 precludes operation of fan 49 during frosting temperature conditions, it also prevents operation of motor 64 during those sensed frosting conditions.

As mentioned hereinabove, the slinger mechanism 60 operates to remove condensate generated only during the heating cycle when the outdoor heat exchanger is functioning as the system evaporator. To this end, means are provided to prevent operation of motor 64 when the system is operating in the cooling cycle when the outdoor heat exchanger is functioning as the system condenser and condensate is normally disposed of as explained above. The means to prevent operation of the motor 64 during the cooling cycle includes a bimetallic thermostat switch 160 that is arranged in heat exchange relationship with a portion of the refrigerant system between the outdoor heat exchanger 32 and the reversing valve 36. When the outdoor heat exchanger 32 is functioning as the system condenser, the switch 160 will sense the relatively warm temperature of the refrigerant being discharged from the compressor 34 and open to prevent energization of the slinger mechanism motor 64. This will prevent condensate from being sprayed into the indoor section during the cooling cycle when the indoor heat exchanger 30 is functioning as the system evaporator, and the condensate is being disposed of in the outdoor compartment as explained above.

The foregoing is a description of the preferred embodiment of the apparatus of the invention and it should be understood that variations may be made thereto without departing from the true spirit of the invention as defined in the appended claims.

What is claimed is:

1. A condensate disposal control means for a self-contained air conditioning unit for heating and cooling an enclosure comprising:

a chassis including a base member and a barrier dividing said chassis into an indoor and outdoor compartment;

a refrigerant circuit including an outdoor heat exchanger and indoor heat exchanger;

a compressor;

a reversing valve for selectively connecting said compressor to said heat exchangers whereby said outdoor heat exchanger functions as an evaporator during operation of said unit on the heating cycle and said indoor heat exchanger funtions as an evaporator during operation of said unit on the cooling cycle;

indoor fan means for moving enclosure air through said indoor heat exchanger;

outdoor fan means for moving outdoor ambient air through said outdoor heat exchanger;

a condensate collecting sump in said base member arranged in said outdoor compartment;

condensate disposal means arranged in said outer compartment including a condensate slinger motor operable in the heating cycle for lifting water when present in said sump and directing said water into the path of air being circulated by said indoor fan means where it is directed through and vaporized in the relatively warm indoor heat exchanger;

a control system for operating said condensate disposal means including:

(a) a thermostat means having a first stage switching means operable for energizing said compressor in said heating cycle when the temperature of said enclosure is a predetermined comfort level, and a second stage switching means operable for deenergizing said compressor when the temperature of said enclosure drops to a second lower pre-determined level during the operation of said compressor in said heating cycle;

(b) a heating means arranged in the path of air through said indoor heat exchanger being energized by said second stage switching means when the temperature of said enclosure drops to the second lower preselected temperature;

(c) a first control temperature sensing means for maintaining operation of said compressor in the heating cycle when said temperature sensed by said temperature sensing means is above a preselected frost accumulation level and for deenergizing said compressor when said temperature sensing means senses a preselected frost accumulation level to place said unit in a defrost mode;

(d) a second control temperature sensing means for maintaining operation of said outdoor fan independent of said first control when the ambient sensed by said temperature sensing means is above a frost accumulation temperature and to complete a circuit to said fan through said first control if said temperature sensing means of said second control senses a preselected frosting temperature to deenergize said outdoor fan when said compressor is deenergized;

(e) circuit means arranging said condensate slinger motor in series with said outdoor fan so that said slinger motor is operable only when said outdoor fan is energized; and (f) a temperature responsive sensing means being arranged in contact with said refrigerant circuit at a location that will sense when said outdoor heat exchanger is functioning as the system condenser to prevent operation of said slinger motor when said unit is in the cooling cycle.

2. The condensate disposal control means recited in claim 1 wherein said temperature responsive sensing means includes switch means in series with said condensate slinger motor that will open under control of said temperature responsive sensing means when said outdoor heat exchanger functions as the system condenser.

3. The condensate disposal control means recited in claim 2 wherein said first control temperature sensing means for maintaining operation of said compressor in the heating cycle when said temperature sensed by said temperature sensing means is above a preselected frost accumulation level and for deenergizing said compressor when said temperature sensing means senses a preselected frost accumulation level to place said unit in a defrost mode.

4. The condensate disposal control means recited in claim 3 where said second control temperature sensing means for maintaining operation of said outdoor fan independent of said first control when the ambient sensed by said temperature sensing means is above a frost accumulation temperature and to complete a circuit to said fan through said first control if said temperature sensing means of said second control senses a preselected frosting temperature to deenergize said outdoor fan when said compressor is deenergized.

* * * * *